United States Patent [19]

Graham et al.

[11] 3,996,117

[45] Dec. 7, 1976

[54] PROCESS FOR PRODUCING ALUMINUM

[75] Inventors: Robert W. Graham, Port Lavaca, Tex.; Stanley C. Jacobs, Lower Burrell, Pa.; Henry G. Wickes, Jr., Port Lavaca, Tex.; Alfred F. LaCamera, Level Green, Pa.

[73] Assignee: Aluminum Company of America, Pittsburgh, Pa.

[22] Filed: Mar. 27, 1974

[21] Appl. No.: 455,374

[52] U.S. Cl. ..... 204/67; 204/245

[51] Int. Cl.[2] ..... C25C 3/06

[58] Field of Search ..... 204/67, 243 R

[56] References Cited

UNITED STATES PATENTS

| | | | |
|---|---|---|---|
| 881,934 | 3/1908 | Kugelgen et al. | 204/243 R |
| 1,782,616 | 11/1930 | Hulin | 204/243 R |
| 2,464,267 | 3/1949 | Short | 204/67 |
| 3,034,972 | 5/1962 | Lewis | 204/67 |
| 3,457,150 | 7/1969 | Vancil et al. | 204/67 |
| 3,852,173 | 12/1974 | Jacobs et al. | 204/67 |
| 3,855,086 | 12/1974 | Sleppy | 204/67 |

*Primary Examiner*—John H. Mack
*Assistant Examiner*—Aaron Weisstuch
*Attorney, Agent, or Firm*—Daniel A. Sullivan, Jr.

[57] ABSTRACT

In a process for producing aluminum, which process conventionally includes electrolytically decomposing alumina to aluminum metal in a molten electrolyte bath between a carbon anode and a cathodic interface formed between a molten aluminum metal pad and sides electrolyte bath, the bath a. being predominantly NaF and $AlF_3$,
b. containing $CaF_2$ and $Al_2O_3$, and
c. being covered by a frozen crust, the improvement including providing in the bath 5 to 10 weight-% LiF, while maintaining in the bath a weight ratio NaF to $AlF_3$ of 1.04 to 1.15, and while maintaining a frozen layer bounding the sizes of the aluminum metal pad and bath.

9 Claims, 1 Drawing Figure

PROCESS FOR PRODUCING ALUMINUM

BACKGROUND OF THE INVENTION

The present invention relates to the electrolytic reduction of alumina to aluminum metal, and more particularly, to a modified Hall-Heroult process for producing aluminum.

U.S. patent application Ser. No. 374,802, filed June 28, 1973 for an ALUMINA REDUCING PROCESS, issued Dec. 3, 1974, as U.S. Pat. No. 3,852,173 describes a new process for producing aluminum metal along the lines originally set forth by Hall and Heroult. The particular examples set forth in that application are characterized by electrolytic cells possessing covers for the purpose of obtaining improved recovery of fumes and for the purpose of maintaining a molten electrolytic bath surface to which alumina is fed directly.

SUMMARY OF THE INVENTION

It is an object of the present invention to provide a process making unexpectedly advantageous use of certain of the novel features set forth in the above-mentioned U.S. Pat. No. 3,852,173 for operating the more conventional Hall-Heroult cell which lacks a cover and which is characterized by a crust over its bath.

Another object of the invention is to provide process parameters which lead to acceptable production of aluminum at lower bath operating temperatures and consequently lower fume production and higher current efficiency. While a cell provided with a cover is one solution to the collection of fumes produced during the electrolytic production of aluminum, it would be desirable to be able to operate a conventional, crusted cell with reduced fume evolution, in order to reduce the cost of capturing and recycling the same.

This, as well as other objects, which will become more apparent in the discussion that follows, are achieved, according to the present invention, by providing a process for producing aluminum, which process conventionally includes electrolytically decomposing alumina to aluminum metal in a molten electrolyte bath between a carbon anode and a cathodic interface formed between a molten aluminum metal pad and the electrolyte bath, the bath a. being predominantly NaF and $AlF_3$, b. containing $CaF_2$ and $Al_2O_3$, and c. being covered by a frozen crust, the improvement comprising providing in the bath 5 to 10 weight-% LiF, while maintaining in the bath a weight ratio NaF to $AlF_3$ of 1.04 to 1.15, and while maintaining a frozen layer bounding the sides of the aluminum metal pad and bath.

As indicated above, the improvement in the process of the present invention includes the combined features of a particular lithium fluoride content and a particular weight ratio of sodium fluoride to aluminum fluoride. Typically, the combined weights of sodium fluoride and aluminum fluoride will make up at least 75% of the bath. Calcium fluoride comes into the bath in company with the charged alumina. It has been found that the calcium fluoride will reach a level of from, for example, 3 to 6 weight-% and then remain constant at that level, despite it being continually added with new alumina charge. The alumina content in baths operated according to the present invention will typically analyze from 2.5 to 5 weight-%. Magnesium fluoride is also typically present in baths used according to the present invention; its level is typically from 0.2 to 0.4 weight-%.

DESCRIPTION OF THE PREFERRED EMBODIMENTS

Figure 1:
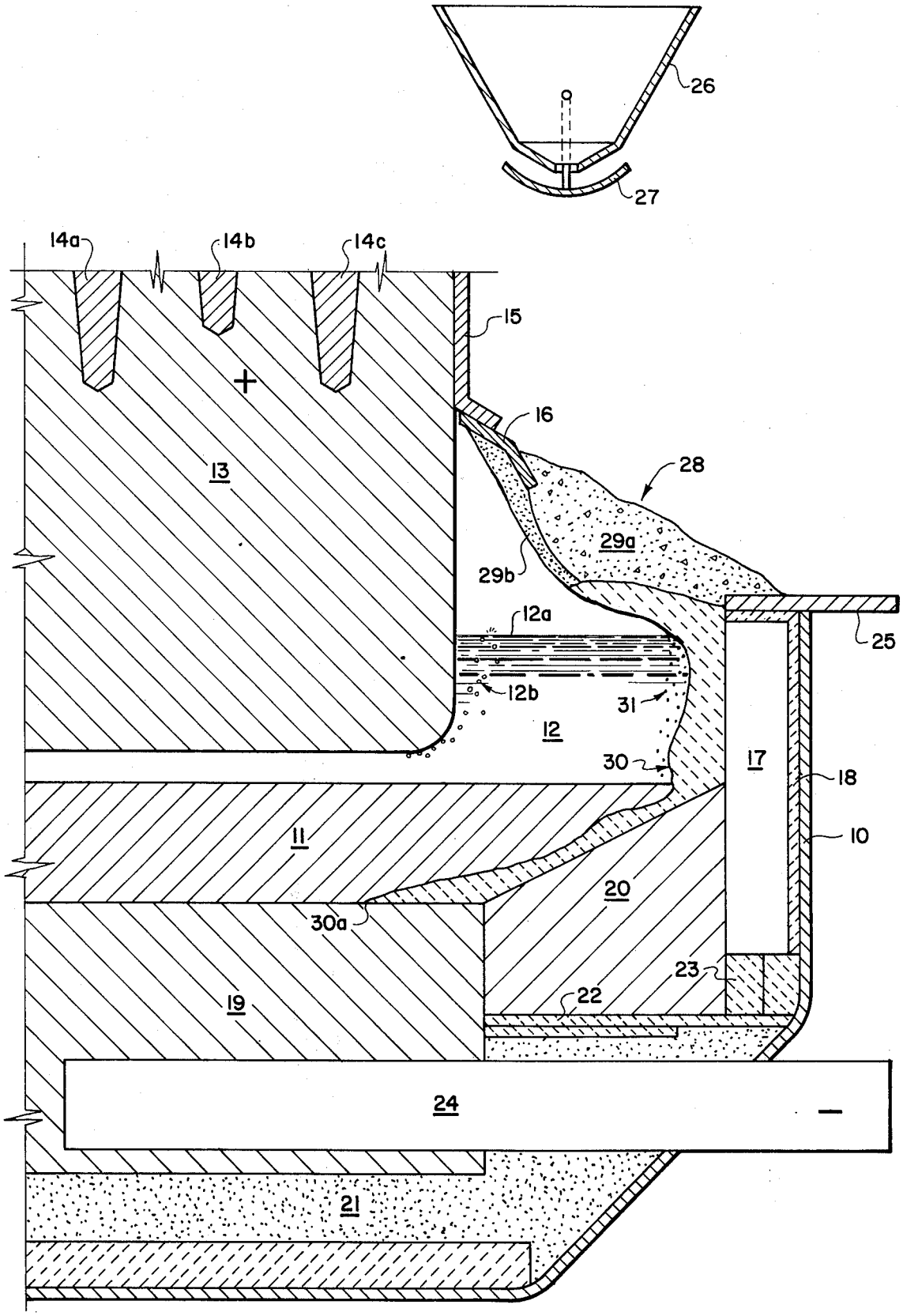
FIG. 1 is an elevational cross-sectional, broken-away view of a Soderberg-anode-type cell for use in the present invention.

With reference to FIG. 1, there is shown a cell which is essentially that shown in the FIG. 1 of the above-mentioned U.S. Pat. No. 3,852,173, with the cover removed.

The cell of the present FIG. 1 represents a preferred cell for carrying out the present invention. The presence of graphite block in its side wall enables it to have a greater heat loss, sideways in FIG. 1, to the environment. This means that greater production of aluminum metal can be obtained, because a greater amount of current can be passed through the cell while yet maintaining the frozen layer of alumina and bath.

While it is preferred to use the cell of FIG. 1, a particular advantage of the present invention is that conventional Hall-Heroult cell constructions can be used for the process herein described. All that is necessary is that the bath chemistry be adjusted to conform to the present invention and that electrical current and/or voltage be adjusted until probing indicates the presence of the desired frozen layer of alumina and bath.

Concerning now the details of FIG. 1, the cell includes a steel shell 10 containing appropriately placed insulating and conducting materials, a molten aluminum metal pad 11 and an electrolyte bath 12. The bath level is at 12*a*, while anode gas (primarily $CO_2$) bubbles appear at 12*b*. Suspended in bath 12 is a Soderberg anode 13. Associated with the Soderberg anode are steel spikes 14*a*, 14*b*, and 14*c*, which are connected to the positive side of a source of electrical current. As is well known, a steel jacket 15 is provided on the upper sides of the anode, where the anode constituents have not yet hardened sufficiently to render themselves self-supporting.

Surrounding the anode is a manifold 16 whose purpose is to provide an upper side for the crust and to promote fume collection through a conventional exhaust burner (not shown).

As mentioned above, this cell is distinctive in that it contains graphite block 17, for example of thickness of 5-inches as measured left and right in FIG. 1, as the material contacting the outer perimeter of the electrolyte bath. Arranged between graphite block 17 and steel shell 10 is mica mat 18 for the purpose of providing an extra degree of safety against current flow through shell 10. Mat thicknesses of from 6 to 20 mils have been used.

The pad 11 of molten aluminum is supported on carbonaceous block lining 19 and carbonaceous tamped lining 20. The carbonaceous linings are supported on an alumina fill 21, there being interposed between the tamped lining and the fill some quarry tile 22. A layer of red brick 23 is situated between the graphite block 17 and the quarry tile 22.

FIG. 1 is a representative vertical section through the cell and it will be realized that, for instance, similar graphite block 17 will appear in other elevational sections through the cell.

The cathode current is supplied through steel connector bars, such as bar 24, to the block lining 19. The current supply is indicated by plus and minus signs on the anode and on connector bar 24 respectively.

A desk plate 25, provided on the upper edge of steel shell 10, serves, among others, the purpose of protecting graphite block 17 when the crust is being broken in for the purpose of feeding additional alumina to the bath 12.

Alumina is charged from hopper 26, which has a suitable opening-closing mechanism 27 on its lower side.

According to the present invention, a crust 28 is present. This crust is formed, above, of loose particles 29*a* of alumina and, as required, electrolyte make-up chemicals. On its lower side, the crust becomes, in part, a sintered alumina-rich material 29*b*.

Operating parameters are selected such that a frozen layer 30 of alumina and bath bounds the sides of the aluminum metal pad 1 and bath 12. It is preferred that layer 30 extend at least down to the bottom of the slope of tamped lining 20, i.e. to beneath the side of anode 13, although in actual practice it may extend to a point 30*a*, for example, four inches inwards from the projection of the side of anode 13 onto the cell bottom without there being any significant limiting of the electrical current flow area at the interface between pad 11 and lining 19. This frozen layer acts as a steadily-feeding source of alumina into the bath for electrolysis and as a barrier to the flow of electrical current from the anode, through the shell 10 to the cathode bar 24.

In actual practice, it has been found that it is advantageous when there exists at the frozen layer a mushy transition region 31, which is made up of bath and suspended particles of alumina. This transition region 31 between the completely molten bath 12 and the frozen sidewall 30 tends to be formed as a matter of course by the conventional practice of breaking crust 28, for example for the purpose of replenishing alumina in the bath or, in the extreme, for extinguishing an anode effect. When this transition region exists, it steadily feeds alumina into solution and makes up for that which is electrolytically decomposed in the building-up of pad 11.

Although the existence of transition region 31 has been found to be very advantageous, it is not necessary that such be the case in order to have a successful process according to the invention. For example, alumina can be fed from bath-exposed alumina-rich regions in the frozen layer 30. Also, it is possible to add to the bath an alumina of high solubility, such as that disclosed in U.S. patent application Ser. No. 374,805, filed June 28, 1973 by W. C. Sleppy for a NOVEL ALUMINA FEED FOR ALUMINUM CELL, issued Oct. 1, 1974, as U.S. Pat. No. 3,839,167.

When applying the present invention to a pre-baked anode type cell fed at gaps between anodes, metal grade alumina may be fed into the bath at a ate substantially not exceeding its rate of solution by supplying it around a pneumatic plunger such as disclosed in U.S. Pat. No. 3,681,229, issued Aug. 1, 1972, to R. L. Lowe.

Feeding at the side of either a Soderberg or a prebake cell can be done by breaking-in the crust, for instance crust 28 in FIG. 1. It is then possible to use large amounts of metal grade alumina in a transition region 31 for steadily feeding alumina into solution without mucking the cell.

Further illustrative of the present invention are the following examples:

EXAMPLE I

A Soderberg cell was operated for producing aluminum with an anode to cathode distance, i.e. the distance between the bottom of the anode and the top of the metal pad, of 1¾ inches and a current flow of 66,000 amperes. The bath composition was, neglecting impurities, in weight-%, 3.5% $CaF_2$, 3.5% $Al_2O_3$, 40% $AlF_3$, 10% LiF, 42.5% NaF and 0.25% $MgF_2$. The calculated weight ration $NaF/AlF_3$ (the "cryolite ratio") for this composition is 1.06. The cell was operated at a temperature of 930° C with a bath depth of 11 inches and a minimum metal depth of 7 inches, average 8 inches. The feed to this cell was alumina which had been heated in a kiln to a water content characterized by a Loss On Ignition (LOI) of 4½%, where Loss On Ignition is defined as the weight loss on heating from 300° to 1100° C. Feeding of alumina was by breaking-in the crust at the side of the cell.

EXAMPLE II

Example I was repeated with the difference that the alumina feed was an alumina conventionally used for aluminum metal production. This alumina is referred to in the trade as "metal grade alumina". The particular metal grade alumina used for this example had a Loss On Ignition of 0.75%. It was found that the crust formed when using metal grade alumina was better adapted for preventing fume leakage than was the higher LOI alumina used in Example I.

EXAMPLE III

A line of cells, referred to as a "pot line", of the Soderberg type was operated for 324 pot-days, produced 327,416 pounds of aluminum and 1010.5 pounds net aluminum per pot-day, and yielded an aluminum product of 99.73% aluminum at an electrical current efficiency of 89.7%. Electrical power consumption was 7.90 kilowatt hours per pound of aluminum. Operation was maintained at 0.646 anode effects per pot-day. The pounds of Soderberg paste consumed per pound net aluminum was 0.587. Consumption of aluminum fluoride was 12,310 pounds, while $Li_2CO_3$ consumption was 5,338 pounds. The anode to cathode distance was between 1¾ and 2 inches. At this time, operation was changed over from the higher-water-content alumina of Example I to metal grade alumina of 0.75 LOI. The feed for two-ninths of the period was the higher-water-content alumina of Example I and the feed for the remainder of the period was metal grade alumina. The technique of feeding was again by breaking-in the crust at the sides of the cells. Volts per pot was 5.24, average amperes 63,474, and kilowatts per pot 333.9. The bath composition was, in weight-%, 3.63% $CaF_2$, 3.99% $Al_2O_3$, 39.8% $AlF_3$, 9.52% LiF, 42.03% NaF and 0.28% $MgF_2$. The calculated weight ratio $NaF/AlF_2$ was 1.06. Bath operating temperature was 934° C.

EXAMPLE IV

For 1,404 pot-days of operation in Soderberg cells, a total of 1,460,300 pounds of aluminum were produced, the pounds net aluminum per pot-day being 1,040.1. Aluminum of 99.73% purity was obtained, with an electrical current efficiency of 93.7% and 7.72 kilowatt hours of electrical energy consumed per pound of aluminum. Operation was at 0.518 anode effects per day. Soderberg paste consumption was 0.608 pounds of paste per pound net aluminum, with $AlF_3$ consumption lying at 78,680 and $Li_2CO_3$ consumption at 15,804. Pot electrical data included a 2-inch anode to cathode distance, 5.35 volts per pot, 62,509 amperes current load, and 334.4 kilowatts per pot. The lithium fluoride content of the bath was, in weight-%, 7.05% with the cryolite ratio (weight-ratio $NaF/AlF_3$) lying at 1.08. Operating temperature was 938° C, and metal grade alumina of 0.75 LOI was utilized, fed by breaking-in the crust at the sides of the cells.

EXAMPLE V

For 4,070 pot-days of Soderberg cell operation (i.e. 131.3 pots for 31 days), 4,139,655 pounds of aluminum were produced for an aluminum production per pot-day of 1,017.1 pounds net aluminum. The aluminum purity was 99.74%, with current efficiency lying at 87.9% and power consumption, kilowatt-hours per pound of aluminum equaling 8.37. Operation was at 0.64 anode effects per day. Materials consumption was 0.505 pounds Soderberg paste per pound net aluminum, 52,800 pounds of cryolite, 177,454 pounds of aluminum fluoride, and 21,499 pounds of lithium carbonate. Electrical parameters were an anode to cathode spacing of 2.3 inches, 5.44 volts per pot, 65,200 amperes of electrical current passing through each pot, and 355 kilowatt hours power per pot. The composition of the electrolyte bath was, in weight-%, 3.66% $CaF_2$, 2.97% $Al_2O_3$, 41.8% $AlF_3$, 5.08% LiF and 0.35% $MgF_2$. The weight ratio $NaF/AlF_3$ was 1.14. Operating temperature was 939° C. Metal grade alumina of 0.75 LOI was used, fed by breaking-in the crust at the sides of the cells. Bath depth was 10.5 inches, and the average peak metal depth before tapping was 9.7 inches.

EXAMPLE VI

For 4,215 pot-days (136 pots for 31 days) of operation of a Soderberg pot line, 4,170,735 pounds of aluminum were produced, giving a pounds net aluminum per pot-day figure of 989.5. Aluminum purity was 99.75%. Electrical current efficiency was 89.8%, with 8.05 kilowatt hours of electrical energy being consumed per pound of aluminum produced. Operation was at 0.57 anode effects per day. Materials consumption was 0.519 pounds Soderberg paste per pound net aluminum, 48,682 pounds of cryolite, 207,836 pounds of aluminum fluoride and 33,593 pounds of lithium carbonate. Electrical parameters were an anode to cathode distance of 2.16 inches, 5.34 volts per pot, a current flow of 66,100 amperes through each pot, and 332 kilowatts per pot. Bath composition was, in weight-%, 3.46% $CaF_2$, 3.90% $Al_2O_3$, 41.9% $AlF_3$, 6.47% LiF and 0.27% $MgF_2$. The weight-ratio $NaF/AlF_3$ was 1.12. Operating temperature was 936° C, with metal grade alumina of 0.75 LOI being the cell feed, the feeding being accomplished by breaking-in crust at the sides of the cells. Electrolyte bath depth was 10.4 inches, and the average maximum metal depth, i.e. the peak depth before tapping, was 9.4 inches.

It will be understood that the above description of the present invention is susceptible to various modifications, changes, and adaptations and the same are intended to be comprehended within the meaning and range of equivalents of the appended claims.

We claim:

1. In a process for producing aluminum, which process conventionally includes electrolytically decomposing alumina to aluminum metal in a molten electrolyte bath between a carbon anode and a cathodic interface formed between a molten aluminum metal pad and the electrolyte bath, the bath a. being predominantly NaF and $AlF_3$, b. containing $CaF_2$ and $Al_2O_3$, and c. being covered by a crust, the improvement comprising providing in the bath 5 to 10 weight-% LiF, while maintaining in the bath a weight ratio NaF to $AlF_3$ of 1.04 to 1.15, and while maintaining a frozen layer bounding the sides of the aluminum metal pad and bath, with the bath temperature during electrolytic decomposition being less than 940° C.

2. In a process as claimed in claim 1, the further improvement that solid alumina is maintained in the bath at the frozen layer.

3. In a process as claimed in claim 1, the further improvement that alumina is fed in the form of metal grade alumina.

4. In a process as claimed in claim 3, the further improvement that the alumina is fed into the bath by breaking-in the crust.

5. In a process for producing aluminum, which process conventionally includes electrolytically decomposing alumina to aluminum metal in a molten electrolyte bath of a side-fed cell between a carbon anode and a cathode interface formed between a molten aluminum metal pad and the electrolyte bath, the bath a. being predominantly NaF and $AlF_3$, b. containing $CaF_2$ and $Al_2O_3$, and c. being covered by a crust, the improvement comprising providing in the bath 5 to 10 weight-% LiF, while maintaining in the bath a weight ratio of NaF to $AlF_3$ of 1.04 to 1.15, and while maintaining a frozen layer bounding the sides of the aluminum metal pad and bath, with the bath temperature during electrolytic decomposition being less than 940° C.

6. In a process as claimed in claim 5, the further improvement that solid alumina is maintained in the bath at the frozen layer during the electrolytic decomposition for producing aluminum metal.

7. In a process as claimed in claim 5, the further improvement that alumina is fed in the form of metal grade alumina.

8. In a process as claimed in claim 7, the further improvement that the alumina is fed into the bath by breaking-in the crust.

9. In a process as claimed in claim 6, the further improvement that the cell is of the Soderberg type.

* * * * *

UNITED STATES PATENT AND TRADEMARK OFFICE

CERTIFICATE OF CORRECTION

PATENT NO. : 3,996,117

DATED : December 7, 1976

INVENTOR(S) : Robert W. Graham et al.

It is certified that error appears in the above-identified patent and that said Letters Patent are hereby corrected as shown below:

| | |
|---|---|
| In the "Abstract", line 6 | After "and" change "sides" to --the--. |
| Col. 3, line 5 | Change "desk" to --deck--. |
| Col. 3, line 20 | Change "1" to --11--. |
| Col. 3, line 57 | Change "ate" to --rate--. |
| Col. 4, line 57 | Change "$NaF/AlF_2$" to --$NaF/AlF_3$--. |
| Claim 5, Col. 6, line 36 | Change "cathode" to --cathodic--. |
| Claim 9, Col. 6, line 58 | Change "6" to --5--. |

Signed and Sealed this

Fifteenth Day of February 1977

[SEAL]

*Attest:*

RUTH C. MASON
*Attesting Officer*

C. MARSHALL DANN
*Commissioner of Patents and Trademarks*